United States Patent [19]

Roelevink et al.

[11] Patent Number: 4,994,710

[45] Date of Patent: Feb. 19, 1991

[54] ADAPTOR FOR A LOW-PRESSURE DISCHARGE LAMP

[75] Inventors: Bauke J. Roelevink; Frans J. Traksel, both of Roosendaal; Johannes A. A. M. Van Heeswijk, Eindhoven, all of Netherlands

[73] Assignee: U.S. Philips Corporation, New York, N.Y.

[21] Appl. No.: 321,607

[22] Filed: Mar. 10, 1989

[30] Foreign Application Priority Data

Mar. 10, 1988 [NL] Netherlands ..... 8800596

[51] Int. Cl.[5] ..... H01R 33/02

[52] U.S. Cl. ..... 313/318; 313/331; 313/49; 313/51; 439/226; 439/232; 439/236; 439/242; 439/612

[58] Field of Search ..... 313/318, 491, 493, 624, 313/49, 51, 331; 439/226, 230, 232, 236, 242, 612, 613; 362/260, 223

[56] References Cited

U.S. PATENT DOCUMENTS

| | | | |
|---|---|---|---|
| 2,659,835 | 11/1953 | Germer | 313/623 |
| 4,275,325 | 6/1981 | Guim | 313/51 |

FOREIGN PATENT DOCUMENTS

| | | | |
|---|---|---|---|
| 240736 | 3/1987 | Fed. Rep. of Germany . | |
| 3602931 | 4/1987 | Fed. Rep. of Germany | 439/236 |
| 355201 | 2/1930 | United Kingdom . | |
| 496625 | 3/1938 | United Kingdom . | |
| 946751 | 9/1959 | United Kingdom . | |
| 01439 | 7/1986 | World Int. Prop. O. . | |

*Primary Examiner*—Donald J. Yusko
*Assistant Examiner*—Michael Horabik
*Attorney, Agent, or Firm*—Brian J. Wieghaus

[57] ABSTRACT

The low-pressure discharge lamp has a tubular lamp vessel provided at its both ends with a lamp cap having a pair of contact pins. Each lamp cap is fixed in an adapter having one central contact pin electrically connected to at least one of the pair of contact pins of the lamp cap. A lamp of ordinary construction when provided with the adaptor is thus suitable for use in a space containing explosive gas.

15 Claims, 2 Drawing Sheets

ADAPTOR FOR A LOW-PRESSURE DISCHARGE LAMP

BACKGROUND OF THE INVENTION

The invention relates to a low-pressure discharge lamp comprising a tubular lamp vessel which is sealed at each of its two ends in a vacuum-tight manner on current supply conductors extending to an adjacent electrode arranged in the lamp vessel;

a respective lamp cap connected to the ends of the lamp vessel, this lamp cap having contact pins connected to a respective current supply conductor.

Such low-pressure discharge lamps are well known and are used, for example, as low-pressure mercury vapour discharge lamps having a coating of fluorescent powder on the inner side of the discharge vessel.

At the starting stage of such lamps, the electrodes are heated by current passage. A potential difference then exists between the contact pins of each of the two lamp caps. The use of these lamps in a space which may contain explosive gases is therefore dangerous.

In order to avoid the risk of explosion, low-pressure discharge lamps are used in which the lamp cap has only one centrally arranged contact pin. These lamps ignite with the use of a high-frequency energy source without the electrodes being preheated.

A disadvantage of low-pressure lamps having lamp caps provided with one central contact pin is that with mechanized production the mounting of these lamp caps requires special machines, which deviate from the machines used for mounting the lamp caps having two contact pins.

SUMMARY OF THE INVENTION

The invention has for its object to provide a lamp of the kind described in the opening paragraph having a simple construction that can be readily realized and renders the lamp suitable for use in spaces which may contain an explosive gas.

According to the invention, this object is achieved in that the lamp caps are fixed in a respective adapter of plastics material, which has a central contact pin, which is electrically connected to at least one contact pin of the relevant lamp cap.

The adapter can have a simple construction and may comprise, for example, a holding member for holding the lamp cap in the adapter and a contact member for electrically connecting a contact pin of the lamp cap to the contact pin of the adapter.

A very simple adapter has securing-contact means for securing the adaptor to at least one of the lamp cap contact pins and also electrically connecting the adaptor contact pin to at least one of the lamp cap contact pins. The securing-contact means may be a holding-/contact member in which these two functions are combined. It is very favourable when this holding/contact member is held fixed in the adapter by the contact pin of the adapter, for example, in that the contact pin is passed through an opening in the holding/contact member and grips around the boundary of said opening.

The holding/contact member may be a metal plate having at least one resilient tongue engaging a contact pin of the lamp cap with clamping fit. The member may also have one or more clamping parts holding the member in the adapter.

A very rigid coupling between the lamp cap and the adapter is obtained when the holding/contact member cooperates with both contact pins of the lamp cap. The member is, for example, a metal plate provided for each contact pin of the lamp cap with an opening, into which at least one resilient tongue extends, which upon insertion of these contact pins is bent together with these pins so as to engage the relevant contact pin with clamping fit.

It is favourable when the contact pins of the lamp cap laterally engage a cam in the adapter and a respective resilient tongue at the holding/contact member urges the contact pins against the relevant cam.

It is particularly favourable when the holding/contact member is a circular disk having radially directed resilient tongues and when the adapter has a continuous wall against which the contact pins of the lamp cap are kept pressed by resilient tongues of the circular disk. This embodiment has the advantage that the adapter can be coupled without preceding rotation in order to align it with respect to the contact pins of the lamp cap.

BRIEF DESCRIPTION OF THE DRAWINGS

Embodiments of the low-pressure discharge lamp according to the invention are shown in the drawings.

In the drawings.

DESCRIPTION OF THE PREFERRED EMBODIMENTS

Figure 1:
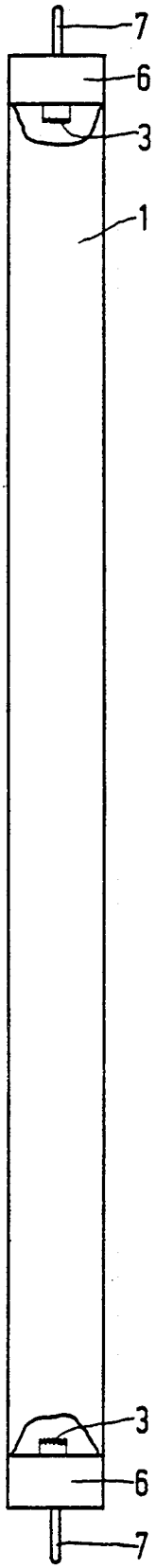
FIG. 1 is a side elevation of a lamp partly broken away.

The low-pressure discharge lamp of FIG. 1 (see also FIG. 2) has a tubular lamp vessel 1, which is sealed at each of its two ends in a vacuum-tight manner on current supply conductors 2, which extend to an adjacent electrode 3 arranged in the lamp vessel 1. The lamp vessel 1 is coated at its inner surface with a fluorescent layer and contains mercury and rare gas. A respective lamp cap 4 is connected to the ends of the lamp cap 1 and has contact pins 5, which are connected to a respective current supply conductor 2. The lamp caps 4 are fixed in a respective adapter 6 of plastics material, for example of polybutylene terephtalate, which has a central contact pin 7, which is electrically connected to at least one contact pin 5 of the lamp cap 4.

In the adapter 6 is provided a holding/contact member 8, which is held fixed in the adapter 6 by the contact pin 7. The contact pin 7 is flanged like a collar around the member 8 at its end located within the adapter 6. The member 8 has resilient tongues 9, which engage the contact pins 5 of the lamp cap 4 with clamping fit and counteract the removal of the adapter 6.

Figure 2:
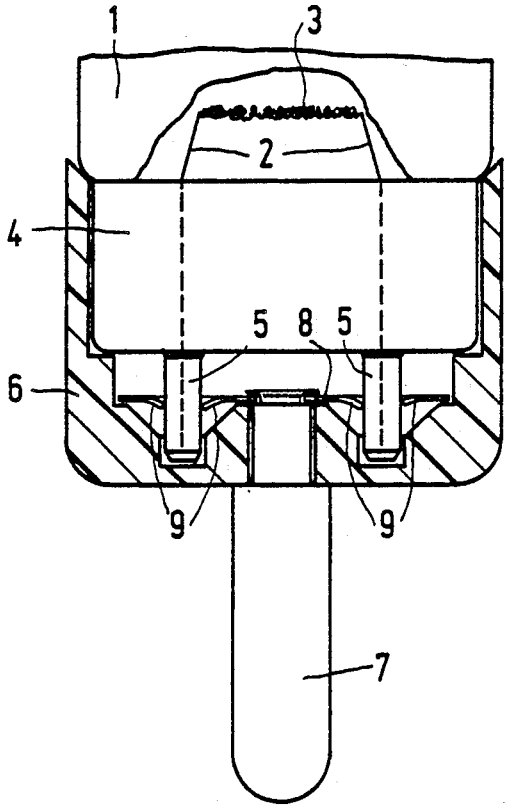
FIG. 2 is a side elevation of an end portion of the lamp shown in FIG. 1 with the adapter in longitudinal sectional view.
Figure 3:
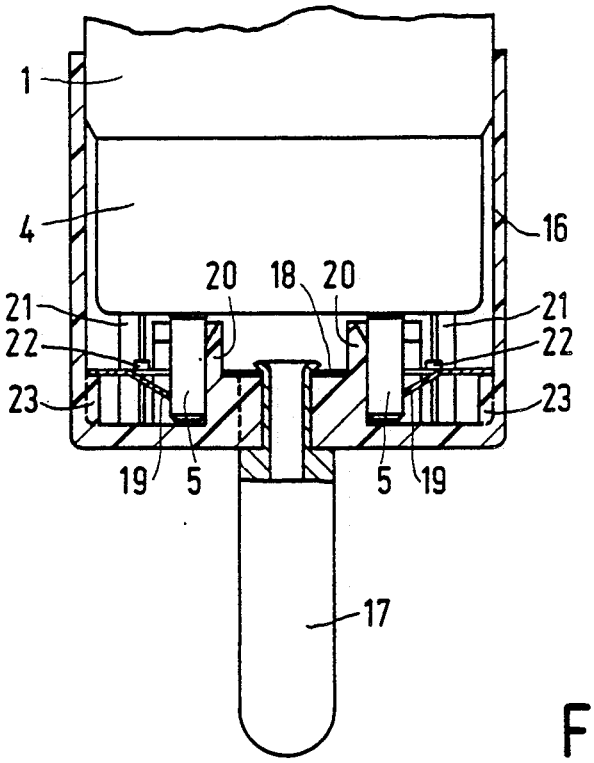
FIG. 3 shows a first variation of FIG. 2.

In FIG. 3, parts of the adapter 16 corresponding to parts of FIG. 2 have a reference numeral which is 10 higher. The adapter 16 is provided with cams 23, which support the holding/contact member 18. The adapter 16 has U-shaped cams 20, against which the contact pins 5 are kept urged by resilient tongues 19. Cams 21 in the adapter 16 constitute an abutment stop for the lamp cap 4. Tongues 22 of the member 18 directed towards the lamp cap 4 cooperate with the cams 21 and constitute an additional fixation for the member 18 in the adapter 16.

Figure 4:
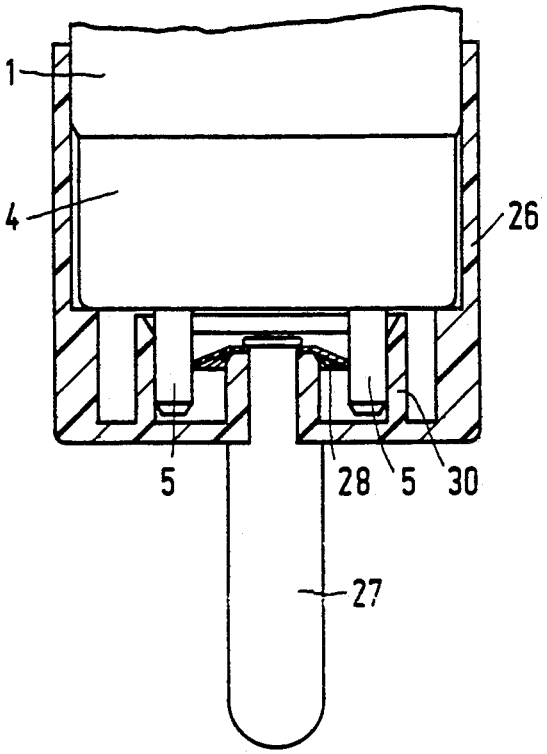
FIG. 4 shows a second variation of FIG. 2.

In FIG. 4, the adapter 26 has a continuous wall 30 which is engaged laterally by the contact pins 5 of the lamp cap 4. The holding/contact member 28 is a circular disk provided with radially directed resilient tongues. The contact pins 5 are kept urged laterally against a continuous wall 30 by resilient tongues of said member 28. The adapter 26 can be arranged at any angular rotation about the lamp cap 4.

We claim:

1. A low-pressure discharge lamp assembly, comprising:

a low-pressure discharge lamp, said lamp comprising a tubular lamp vessel having ends sealed in a gas-tight manner, a pair of electrodes each disposed within said lamp vessel adjacent to respective sealed end, a lamp cap comprising a pair of contact pins fixed on each sealed end, and current supply conductors connecting said contact pins to a respective electrode; and an adaptor mounted on each lamp cap, each adaptor comprising a shell of synthetic material enclosing said lamp cap contact pins, a single contact pin extending from said shell, said securing-contact means for securing said adaptor to a respective lamp cap contact pin and for electrically connecting said adaptor contact pin to a respective lamp cap contact pin, said means resiliently receiving a lamp cap contact pin in the insertion direction of said pin in said adaptor and lockingly securing said pin in the opposite direction to hold said adaptor on said lamp cap.

2. A low-pressure discharge lamp assembly as claimed in claim 1, characterized in that the securing-contact means is held fixed in the adapter by the contact pin of the adapter.

3. A low-pressure discharge lamp assembly as claimed in claim 1, characterized in that the securing-contact means has a resilient tongue, which engages with clamping fit a contact pin of the lamp cap.

4. A low-pressure discharge lamp assembly as claimed in claim 3, characterized in that the adaptor comprises a cam for laterally supporting the contact pin of the lamp cap engaged by said resilient tongue.

5. A low-pressure discharge lamp assembly as claimed in claim 4, characterized in that a respective resilient tongue engages with clamping fit each contact pin of the lamp cap.

6. A low-pressure discharge lamp assembly as claimed in claim 2, characterized in that the securing-contact means is a circular disk having radially directed resilient tongues and the adapter has a continuous wall, against which the contact pins of the lamp cap are laterally urged by said resilient tongues.

7. A low-pressure discharge lamp assembly as claimed in claim 2, characterized in that the securing contact means has a resilient tongue, which engages with clamping fit a contact pin of the lamp cap.

8. A low-pressure discharge lamp assembly as claimed in claim 3, characterized in that the adaptor comprises a cam for laterally supporting the contact pin of the lamp cap engaged by said resilient tongue.

9. A low-pressure discharge lamp assembly as claimed in claim 8, characterized in that a respective resilient tongue engages with clamping fit each contact pin of the lamp cap.

10. An adaptor for a lamp cap of a low pressure mercury vapor discharge lamp, said adaptor comprising:

a shell comprising synthetic material for receiving a two-pin lamp cap of a low pressure mercury discharge lamp, a single contact pin extending from said shell; and securing-contact means for securing said adaptor to a said lamp cap contact and electrically connecting said adaptor contact pin to a lamp cap contact pin when said adaptor is mounted on said lamp cap, said means resiliently receiving a lamp cap contact pin in the insertion direction of said pin in said adaptor and lockingly securing said pin in the opposite direction to hold said adaptor in said lamp cap.

11. An adaptor as claimed in claim 10, wherein said securing means and said contact means comprises a metallic resilient tongue having one end secured in said adaptor and electrically connected to said central contact pin, said tongue having a length chosen so that said tongue engages a contact pin of a said lamp cap when said adaptor is assembled on a said lamp cap.

12. An adaptor as claimed in claim 11, wherein said adaptor further comprises a cam for laterally supporting said lamp cap contact pin engaged by said resilient tongue when said lamp cap is received in said adaptor.

13. An adaptor as claimed in claim 10, wherein said securing means and said contact means comprises a metallic disc transverse to said tubular portion having radially directed resilient tongues which engage said contact pins of a said lamp cap when said lamp cap is received in said adaptor, a continuous wall against which said lamp cap contact pins are biased by said resilient tongues, and said central contact pin of said adaptor having a terminal portion extending through said end wall securing said disc in said adaptor.

14. A low-pressure discharge lamp assembly as claimed in claim 12, characterized in that the securing-contact means is held fixed in the adaptor by the contact pin of the adaptor.

15. An adaptor as claimed in claim 10, characterized in that the securing-contact means is held fixed in the adaptor by the contact pin of the adaptor.

* * * * *